US011248451B2

(12) United States Patent
Sevadjian et al.

(10) Patent No.: US 11,248,451 B2
(45) Date of Patent: Feb. 15, 2022

(54) BIAS FABRIC REINFORCED ELH ELEMENT MATERIAL FOR IMPROVED ANCHORING

(71) Applicant: Halliburton Energy Services, Inc., Houston, TX (US)

(72) Inventors: Emile Edmund Sevadjian, Carrollton, TX (US); Chad William Glaesman, McKinney, TX (US); Gary Allen Kohn, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 26 days.

(21) Appl. No.: 16/446,976

(22) Filed: Jun. 20, 2019

(65) Prior Publication Data

US 2020/0399992 A1 Dec. 24, 2020

(51) Int. Cl.
*E21B 43/10* (2006.01)
*E21B 23/01* (2006.01)

(52) U.S. Cl.
CPC ..... *E21B 43/108* (2013.01); *E21B 23/01* (2013.01); *E21B 43/105* (2013.01)

(58) Field of Classification Search
CPC ..... E21B 43/108; E21B 23/01; E21B 43/105
See application file for complete search history.

(56) References Cited

U.S. PATENT DOCUMENTS 2,143,106 A 1/1939 Freedlander
3,415,700 A 12/1968 Webster
3,583,463 A 6/1971 O'Neil et al.
4,273,160 A 6/1981 Lowles
5,579,839 A * 12/1996 Culpepper ..... E21B 33/1208 166/118
6,343,791 B1 * 2/2002 Anyan ..... E21B 33/1216 277/337

(Continued)

FOREIGN PATENT DOCUMENTS

CN 105556194 2/2018
WO 2016003464 1/2016

OTHER PUBLICATIONS

International Search Report and Written Opinion, Application No. PCT/US2019/038252, dated Mar. 18, 2020.

(Continued)

*Primary Examiner* — Abby J Flynn
*Assistant Examiner* — Jonathan Malikasim
(74) *Attorney, Agent, or Firm* — Scott Richardson; C. Tumey Law Group PLLC

(57) ABSTRACT

The present disclosure relates generally to equipment utilized and operations performed in conjunction with a subterranean well and, more particularly, to an improved liner hanger system. A downhole expandable liner hanger positioned in a subterranean wellbore may comprise a liner. The downhole expandable liner hanger may further comprise an expansion element. The expansion element may comprise one or more annular seals bonded to the expansion element, a first spike; and a second spike. The downhole expandable liner hanger may further comprise a woven mesh, wherein the woven mesh is disposed around the expansion element between the first spike and the second spike, wherein the woven mesh comprises a first material layer and a second material layer.

20 Claims, 5 Drawing Sheets

(56) References Cited

U.S. PATENT DOCUMENTS

| | | | | |
|---|---|---|---|---|
| 7,331,581 | B2 * | 2/2008 | Xu | E21B 33/1216 166/187 |
| 7,360,592 | B2 * | 4/2008 | McMahan | E21B 23/01 166/207 |
| 7,552,776 | B2 * | 6/2009 | Noel | E21B 17/08 166/207 |
| 8,261,842 | B2 | 9/2012 | Moeller | |
| 8,627,884 | B2 | 1/2014 | Watson | |
| 9,243,468 | B2 | 1/2016 | Yee | |
| 2005/0269108 | A1 | 12/2005 | Whanger et al. | |
| 2014/0174763 | A1 | 6/2014 | Zhong et al. | |
| 2015/0308216 | A1 | 10/2015 | Wiggins et al. | |
| 2016/0024895 | A1 * | 1/2016 | Russell | B01D 35/02 166/230 |
| 2016/0356131 | A1 | 12/2016 | Humphrey et al. | |
| 2017/0356269 | A1 * | 12/2017 | Denton | E21B 33/1208 |
| 2018/0051531 | A1 | 2/2018 | Akbari | |

OTHER PUBLICATIONS

Netherlands Search Report and Written Opinion with English Translation for Application No. NL2025580 dated Feb. 15, 2021.

* cited by examiner

BIAS FABRIC REINFORCED ELH ELEMENT MATERIAL FOR IMPROVED ANCHORING

BACKGROUND

During wellbore operations, it is typical to "hang" a liner onto a casing such that the liner supports an extended string of tubular below it. As used herein, "tubing string" refers to a series of connected pipe sections, casing sections, joints, screens, blanks, cross-over tools, downhole tools and the like, inserted into a wellbore, whether used for drilling, work-over, production, injection, completion, or other processes. A tubing string may be run in and out of the casing, and similarly, tubing string can be run in an uncased wellbore or section of wellbore. Further, in many cases a tool may be run on a wireline or coiled tubing instead of a tubing string, as those of skill in the art will recognize.

Expandable liner hangers may generally be used to secure the liner within a previously set casing or liner string. Expandable liner hangers may be "set" by expanding the liner hanger radially outward into gripping and sealing contact with the casing or liner string. For example, expandable liner hangers may be expanded by use of hydraulic pressure to drive an expanding cone, wedge, or "pig," through the liner hanger. Other methods may be used, such as mechanical swaging, explosive expansion, memory metal expansion, swellable material expansion, electromagnetic force-driven expansion, etc.

The expansion process may typically be performed by means of a setting tool used to convey the liner hanger into the wellbore. The setting tool may be interconnected between a work string (e.g., a tubular string made up of drill pipe or other segmented or continuous tubular elements) and the liner hanger. The setting tool may expand the liner hanger into anchoring and sealing engagement with the casing.

As can be appreciated, the expanded liner hanger may support the substantial weight of the attached tubing string below. For deep and extra-deep wells, subsea wells, etc., the tubing string places substantial axial load on the hanging mechanism engaging the liner hanger to the casing. Typically, the sealing elements of an expandable liner hanger may experience extrusion and high load expansion.

BRIEF DESCRIPTION OF THE DRAWINGS

For a detailed description of the embodiments of the present disclosure, reference will now be made to the accompanying drawings in which.

DETAILED DESCRIPTION

The present disclosure relates generally to equipment utilized and operations performed in conjunction with a subterranean well and, more particularly, to an improved liner hanger system. More specifically, an improved downhole expandable liner hanger with a reinforced rubber element. The improved liner hanger may include a rubber element bonded to a tubular body that may then be expanded in an open-ended environment where only the strength of the rubber element may be available to withstand certain forces for a successful installation. An improvement in the rubber element may improve performance related to sealing and anchoring capacity.

Illustrative embodiments of the present disclosure are described in detail below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but it would nevertheless be a routine undertaking for those of ordinary skill in the art having the benefit of the present disclosure.

In order to facilitate a better understanding of the present disclosure, the following examples of certain embodiments are given. In no way should the following examples be read to limit, or define, the scope of the disclosure. Embodiments may be applicable to injection wells as well as production wells, including hydrocarbon wells. Devices and methods in accordance with certain embodiments may be used in one or more of wireline, measurement-while-drilling (MWD) and logging-while-drilling (LWD) operations. Certain embodiments according to the present disclosure may provide for a single trip liner setting and drilling assembly.

Figure 1:
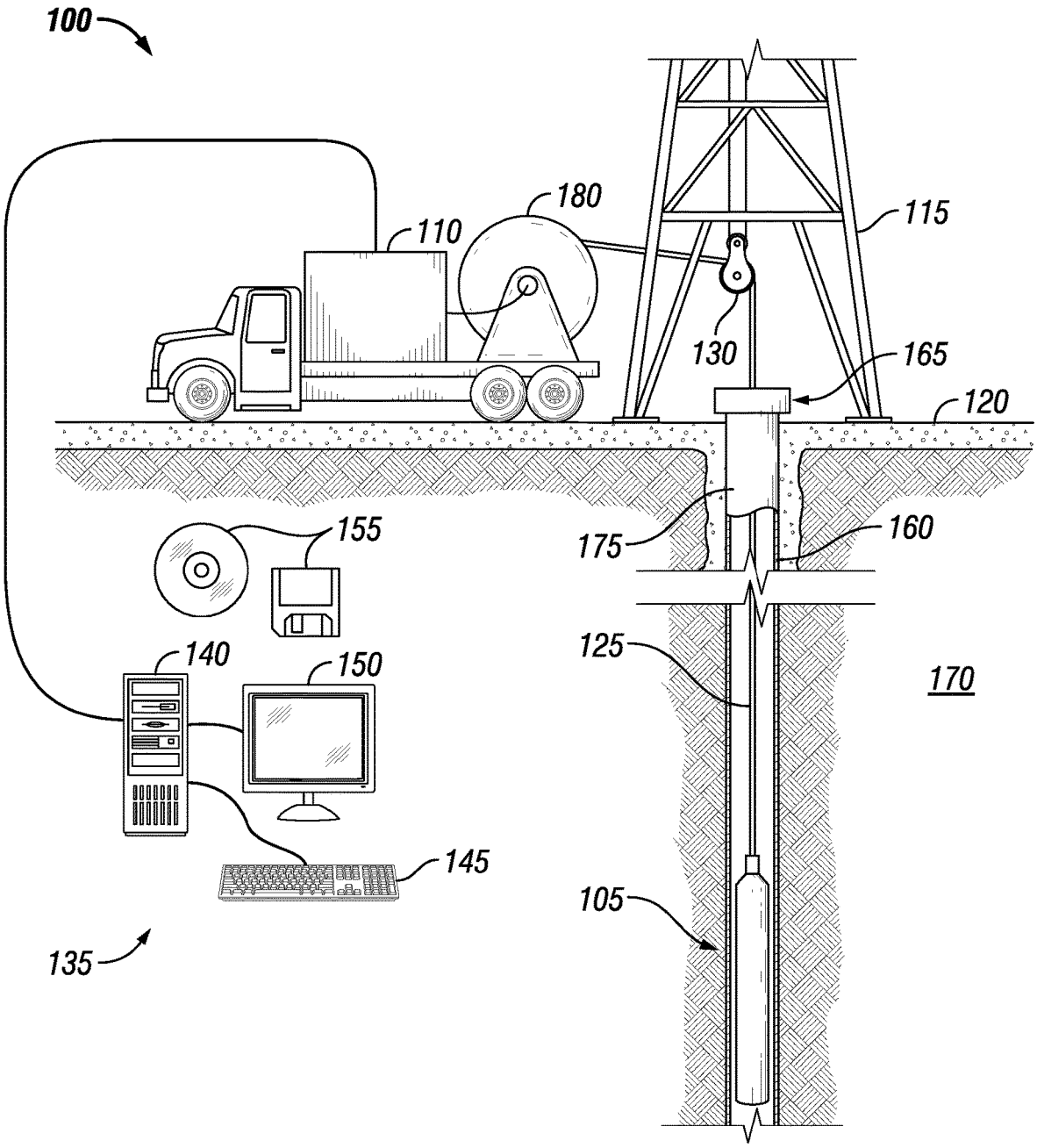
FIG. 1 illustrates an example of a well system.

FIG. 1 illustrates a cross-sectional view of a well system 100. As illustrated, well system 100 may include an expandable liner hanger 105 attached to a vehicle 110. In examples, it should be noted that expandable liner hanger 105 may not be attached to a vehicle 110 but may be attached to any other suitable object. Expandable liner hanger 105 may be supported by a rig 115 at a surface 120. Expandable liner hanger 105 may be tethered to vehicle 110 through a conveyance 125. Conveyance 125 may be disposed around one or more sheave wheels 130 located on vehicle 110. During operations, the one or more sheave wheels 130 may rotate to lower and/or raise conveyance 125 downhole. As expandable liner hanger 105 is coupled to conveyance 125, expandable liner hanger 105 may be displaced accordingly with conveyance 125. Conveyance 125 may include any suitable means for providing mechanical conveyance for expandable liner hanger 105 including, but not limited to, wireline, slickline, coiled tubing, pipe, drill pipe, drill string, tubular string, downhole tractor, and/or the like. In some embodiments, conveyance 125 may provide mechanical suspension, as well as electrical connectivity, for expandable liner hanger 105. In examples, expandable liner hanger 105 may be disposed about a downhole tool (not illustrated). Without limitations, the downhole tool may be any suitable downhole tool configured to perform a well completions operation and/or to obtain measurements while downhole. Information, such as measurements, from the downhole tool may be gathered and/or processed by an information handling system 135.

Systems and methods of the present disclosure may be implemented, at least in part, with information handling system 135. Information handling system 135 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, information handling system 135 may include a processing unit 140, a network storage device, or any other suitable device and may vary in size, shape, performance, functionality, and price. Information handling system 135 may include random access memory (RAM), one or more processing resources such as a central processing unit (CPU) or hardware or software control logic, ROM, and/or other types of nonvolatile memory. Additional components of the information handling system 135 may include one or more disk drives, one or more network ports for communication with external devices as well as various input and output (I/O) devices, such as an input device 145 (e.g., keyboard, mouse, etc.) and a video display 150. Information handling system 135 may also include one or more buses operable to transmit communications between the various hardware components.

Alternatively, systems and methods of the present disclosure may be implemented, at least in part, with non-transitory computer-readable media 155. Non-transitory computer-readable media 155 may include any instrumentality or aggregation of instrumentalities that may retain data and/or instructions for a period of time. Non-transitory computer-readable media 155 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

As illustrated, expandable liner hanger 105 may be disposed in a wellbore 160 by way of conveyance 125. Wellbore 160 may extend from a wellhead 165 into a subterranean formation 170 from surface 120. Wellbore 160 may be cased and/or uncased. In examples, wellbore 160 may include a metallic material, such as a tubular string 175. By way of example, tubular string 175 may be a casing, liner, tubing, or other elongated tubular disposed in wellbore 160. As illustrated, wellbore 160 may extend through subterranean formation 170. Wellbore 160 may generally extend vertically into the subterranean formation 170. However, wellbore 160 may extend at an angle through subterranean formation 170, such as horizontal and slanted wellbores. For example, although wellbore 160 is illustrated as a vertical or low inclination angle well, high inclination angle or horizontal placement of the well and equipment may be possible. It should further be noted that while wellbore 160 is generally depicted as a land-based operation, those skilled in the art may recognize that the principles described herein are equally applicable to subsea operations that employ floating or sea-based platforms and rigs, without departing from the scope of the disclosure.

In examples, rig 115 includes a load cell (not shown) which may determine the amount of pull on conveyance 125 at surface 120 of wellbore 160. While not shown, a safety valve may control the hydraulic pressure that drives a drum 180 on vehicle 110 which may reel up and/or release conveyance 125 which may move expandable liner hanger 105 up and/or down wellbore 160. The safety valve may be adjusted to a pressure such that drum 180 may only impart a small amount of tension to conveyance 125 over and above the tension necessary to retrieve conveyance 125 and/or expandable liner hanger 105 from wellbore 160. The safety valve may typically be set a few hundred pounds above the amount of desired safe pull on conveyance 125 such that once that limit is exceeded, further pull on conveyance 125 may be prevented.

Figure 2:
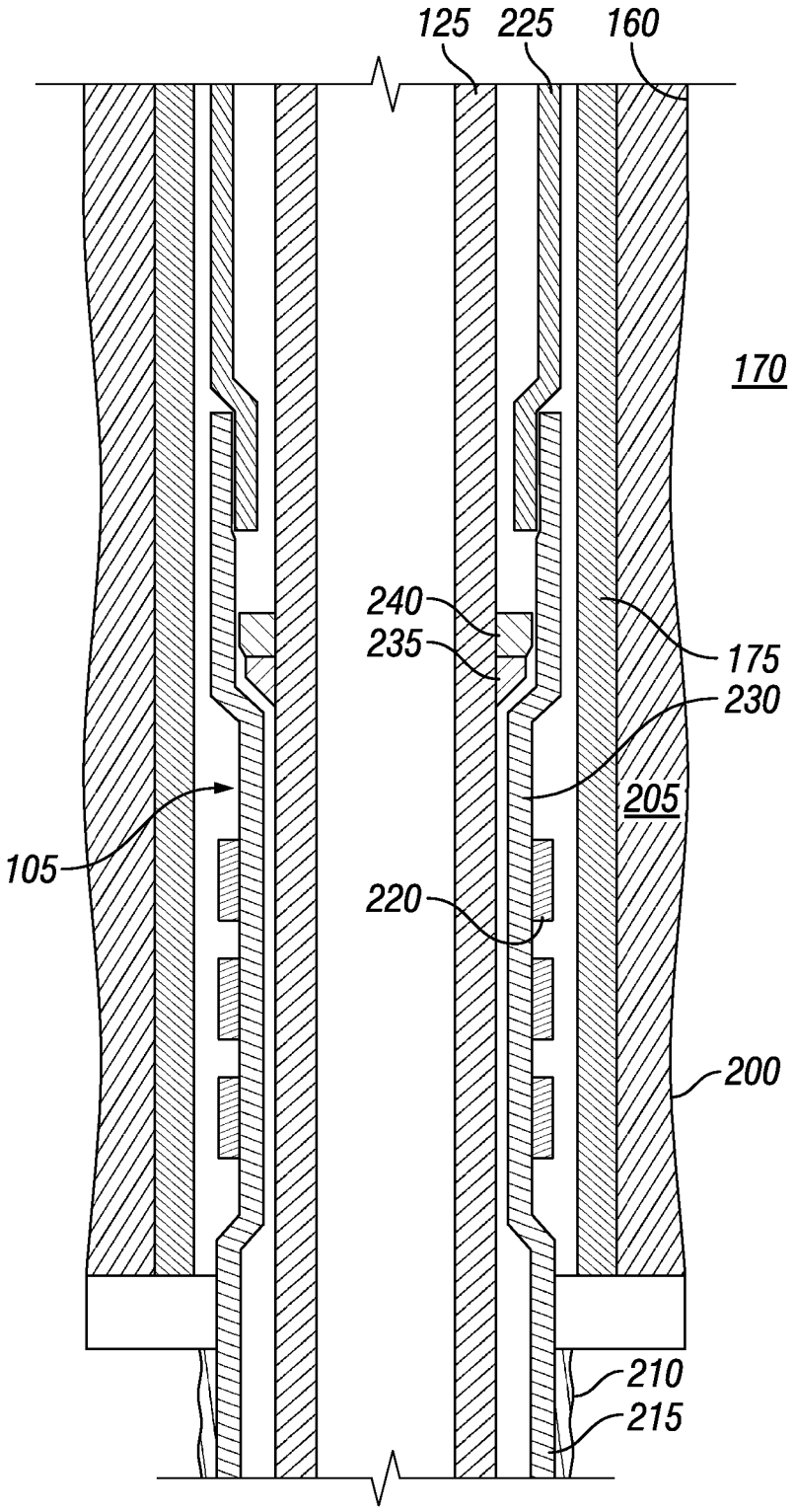
FIG. 2 illustrates an example of an expandable liner hanger.

FIG. 2 illustrates an example of expandable liner hanger 105. As shown in FIG. 2, wellbore 160 may be drilled through subterranean formation 170. A tubular string 175 may then be placed in an upper portion 200 of wellbore 160 and held in place by cement 205, which is injected between tubular string 175 and upper portion 200 of wellbore 160. Below tubular string 175, a lower portion 210 of wellbore 160 may be drilled through tubular string 175. Lower portion 210 may have a smaller diameter than upper portion 200. A length of a liner 215 of expandable liner hanger 105 is shown positioned within lower portion 210. Liner 215 may be used to line or case lower portion 210 and/or to drill lower portion 210. If desired, cement 205 may be placed between liner 215 and lower portion 210 of wellbore 160. Liner 215 may be installed in wellbore 160 by means of conveyance 125. In examples, both tubular string 175 and expandable liner hanger 105 may be elastically and/or plastically strained.

Attached to the upper end of, or formed as an integral part of, liner 215 is expandable liner hanger 105, which may include a number of annular seals 220 including a rubber element, polymer host, elastomer, and/or combinations thereof. While three seals 220 on each side are depicted for illustrative purposes, any number of seals 220 may be used. It may be desirable that the outer diameter of liner 215 be as large as possible while being able to lower liner 215 through tubular string 175. It may also be desirable that the outer diameter of a polished bore receptacle 225 and expandable liner hanger 105 be about the same as the diameter of liner 215. In the run-in condition, the outer diameter of expandable liner hanger 105 is defined by the outer diameter of annular seals 220. In the run-in condition, an expansion element 230 of expandable liner hanger 105 may have an outer diameter reduced by about the thickness of annular seals 220 so that the outer diameter of annular seals 220 is about the same as the outer diameter of liner 215 and polished bore receptacle 225. The majority of the designs used for annular seals 220 may utilize a contained system to prevent the rubber element from extruding or moving out of the seal gland. Examples of these seal designs include O-rings, x-seals, t-seals, and packers. Generally, liner hangers may be unique because they require conveyance before expansion, which results in an open-ended containment system during in situ expansion.

Applied mechanical stress, fluid stress, temperature, and fluid compatibility all work to reduce the physical properties of rubber elements within annular seals 220. When applied to a solid expandable liner hanger, the rubber element must withstand several different scenarios that are unique to the application. During run-in-hole (RIH), the outbound surface of the rubber element may be exposed to drilling fluids and the inner surface must remain securely bonded to the tubular. During expansion, the same rubber element may be able to withstand up to a 10% diametrical expansion. Further, the rubber element may support a high compressive load when interacting with the casing, and in the case of the standard 12-inch element, a resultant shear force may be generated acting to effectively extrude the rubber element. Further, increased temperature may degrade mechanical properties needed to withstand all of these scenarios. Thus, once conveyed, the rubber element may withstand extrusion forces at high pressure and temperatures. While improvements may be made to the manner in which the rubber elements are loaded, a separate improvement in expandable liner hanger 105 may help improve performance in terms of both sealing and anchoring capacity.

FIG. 2 further illustrates first and second expansion cones 235 and 240, which may be carried on conveyance 125 just above reduced diameter expansion element 230 of expandable liner hanger 105. Fluid pressure applied between conveyance 125 and expandable liner hanger 105 may be used to drive first and second expansion cones 235, 240 downward through expandable liner hanger 105 to expand expansion element 230 to an outer diameter at which annular seals 220 are forced into sealing and supporting contact with tubular string 175.

Figure 3:
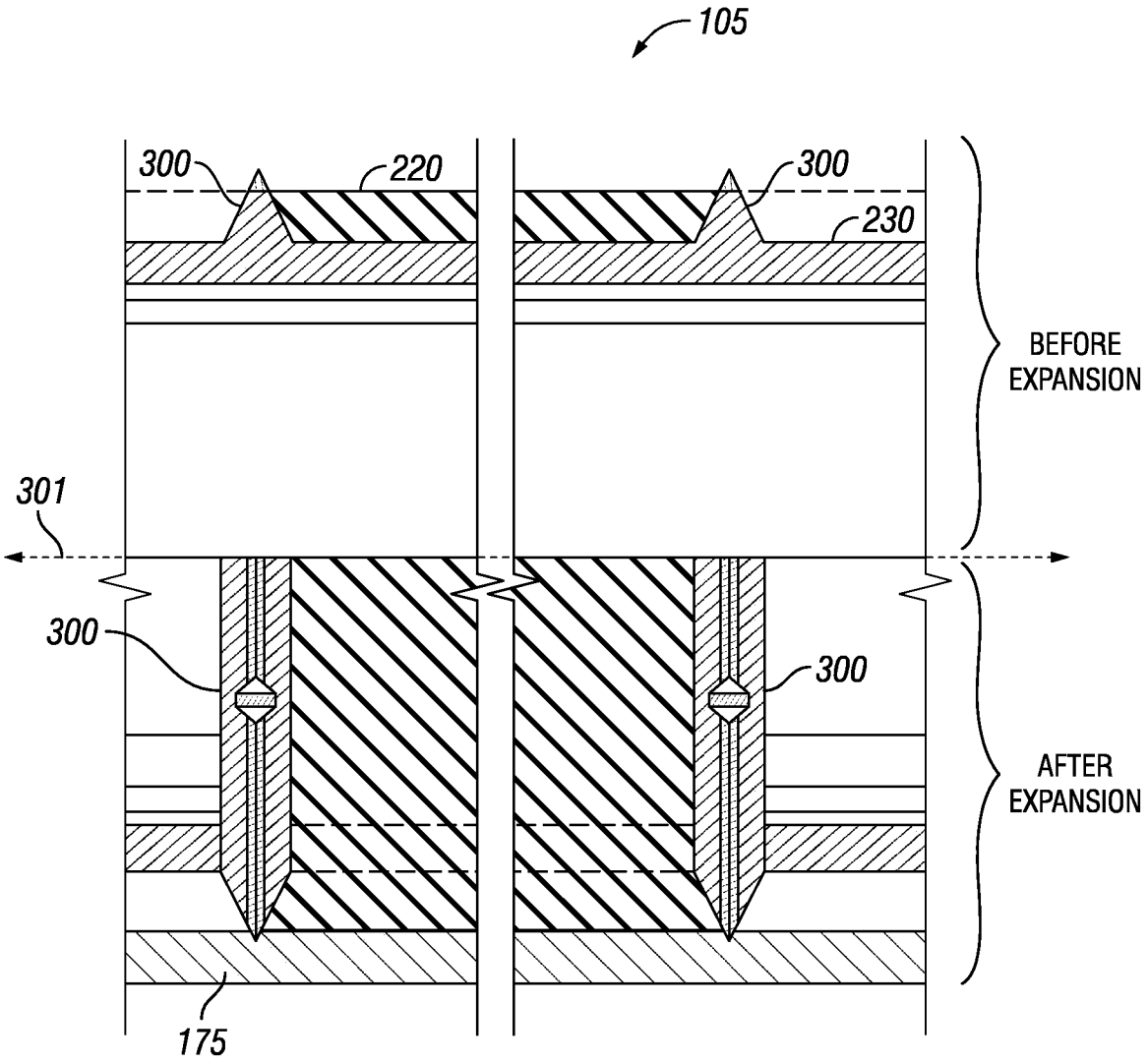
FIG. 3 illustrates a portion of an expansion element of a liner hanger with spikes.

FIG. 3 illustrates a portion of expansion element 230 of expandable liner hanger 105. FIG. 3 further illustrates annular seals 220 disposed between containment spikes 300. Spikes 300 may be metal spikes. The metal spikes may be made of any suitable steel grade, aluminum, any other ductile material, or a combination thereof. Spikes 300 may be any suitable size, height, and/or shape. In certain implementations, each spike 300 may be a circular ring that extends along an outer perimeter of expandable liner hanger 105 at a desired axial location. However, the present disclosure is not limited to this particular configuration of spikes 300. For instance, spikes 300 may extend along an axial direction 301 of expandable liner hanger 105. Moreover, in certain implementations, different spikes 300 may have different surface geometries without departing from the scope of the present disclosure. Specifically, a first spike may extend along an outer perimeter of expandable liner hanger 105 at a first axial position along expandable liner hanger 105, and a second spike may extend along an outer perimeter of expandable liner hanger 105 at a second axial position along expandable liner hanger 105.

Figure 4:
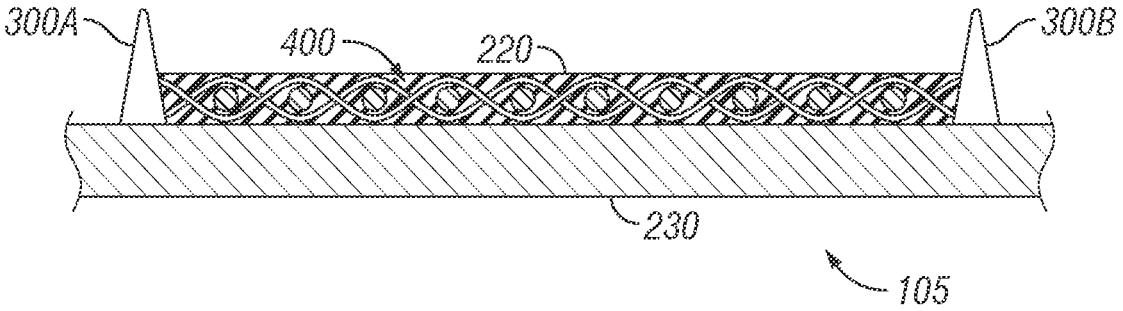
FIG. 4 illustrates an example of a woven mesh disposed within an expansion element.

FIG. 4 illustrates an example of annular seal 220 disposed between a first spike 300A and a second spike 300B. As illustrated, annular seal 220 may include a woven mesh 400. Woven mesh 400 may serve as reinforcement for annular seal 220. Woven mesh 400 may be any suitable size, height, and/or shape. Without limitation, a suitable shape may include, but is not limited to, cross-sectional shapes that are circular, elliptical, triangular, rectangular, square, hexagonal, and/or combinations thereof. Without limitation, woven mesh 400 may include any suitable material such as metals, nonmetals, polymers, ceramics, and/or any combination thereof. In examples, woven mesh 400 may include metals such as stainless steel (e.g., Alloy 20, 300 Series Stainless), carbon steels and alloys (e.g., 10xx types), and nickel alloys (e.g., Nickel Alloy 825 an alloy of nickel, iron, and chromium), among others. Woven mesh 400 may be disposed around expansion element 230 of expandable liner hanger 105 prior to disposing annular seal 220 around expansion element 230 between first spike 300A and second spike 300B. The components of annular seal 220 may be combined with woven mesh 400 prior to vulcanization of annular seal 220. During vulcanization, annular seal 220 may bond with woven mesh 400 as woven mesh 400 is disposed within annular seal 220. Woven mesh 400 may retain structural integrity and provide added strength to annular seal 220 during expansion. As such, woven mesh 400 may expand in a radial direction. Further, woven mesh 400 may minimize extrusion of annular seal 220 and prevent element fracture than can result in rubber dislocation and losses. Without limitations, woven mesh 400 may be utilized for tubular strings 175 (e.g., referring to FIG. 1) including diameters of about at least 20 inches (51 cm). In these examples, there may be weld beads present along the length of the internal diameter of tubular string 175. As such, an operator may be limited as to which liner hangers to use as metal-to-metal contact from spikes 300 (e.g., referring to FIG. 3) may damage tubular string 175. In examples, an operator may be defined as an individual, group of individuals, or an organization. Woven mesh 400 may enhance the effective crush resistance, extrusion resistance, performance at higher temperatures, axial load capacity, and/or combinations thereof for expandable liner hanger 105.

Figure 5:
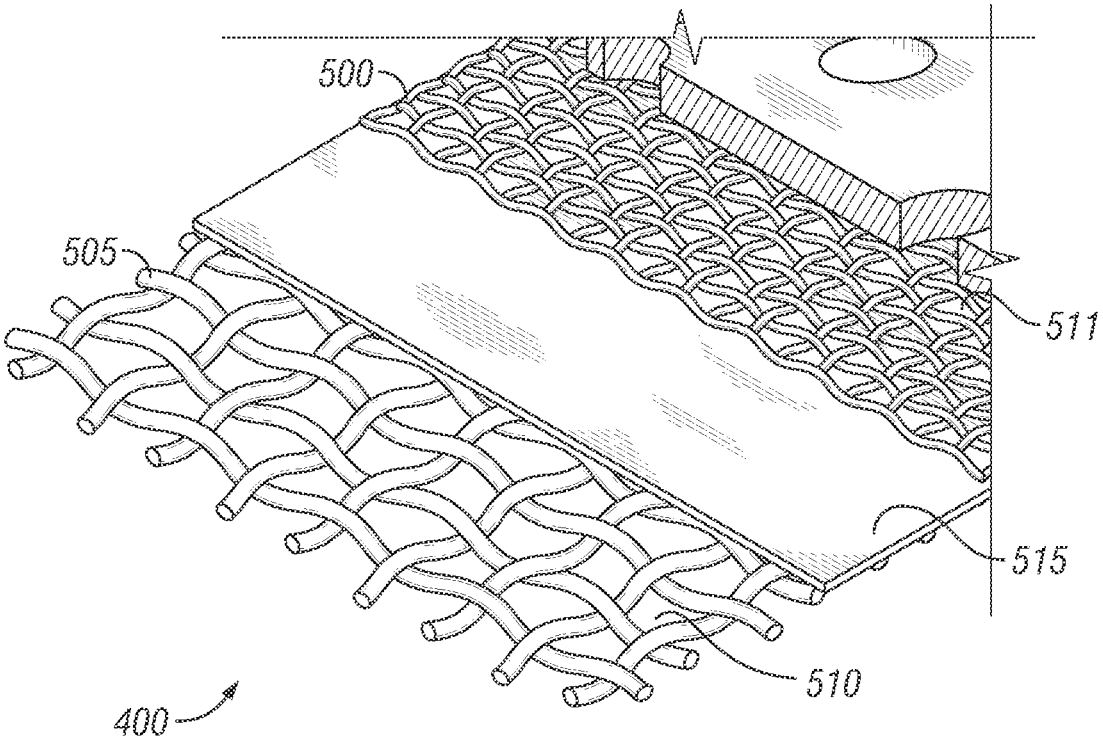
FIG. 5 illustrates an example of a woven mesh.
Figure 6:
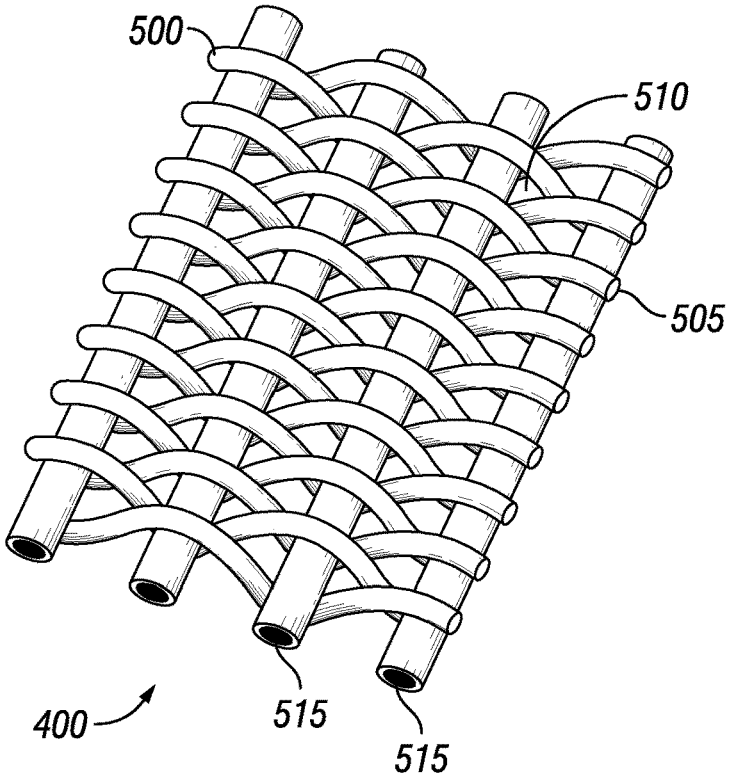
FIG. 6 illustrates an example of a woven mesh.

FIGS. 5 and 6 illustrate examples of woven mesh 400. FIG. 5 illustrates an expanded view of woven mesh 400. FIG. 6 illustrates a configuration of woven mesh 400. As illustrated, woven mesh 400 may include a plurality of layers of material. With respect to the present examples, woven mesh 400 may include at least a first material layer 500 and a second material layer 505, wherein first material layer 500 and second material layer 505 are woven together. Without limitations, first material layer 500 and second material layer 505 may be woven into any suitable pattern, such as the plain weave, oxford, twill, herringbone, dobby, satin, velvet, basket weave, jacquard, leno, and/or combinations thereof. First material layer 500 and second material layer 505 may include individual strands of a specific material, which may be the same or different materials. In certain examples, the material present in first material layer 500 may be similar to or different from the material present in second material layer 505. In examples, first material layer 500 and/or second material layer 505 may each be pre-woven prior to engaging first material layer 500 with second material layer 505. In those examples, there may be holes 510 and holes 511 present between the respective individual strands of a specific material. Holes 510 may be any suitable size, height, and/or shape. There may be a third material layer 515 disposed between first material layer 500 and second material layer 505. In examples, third material layer 515 may be a solid sheet of material, as best seen on FIG. 5. In other examples, third material layer 515 may include strands of material disposed parallel to each other, wherein third material layer 515 is interwoven between first material layer 500 and second material layer 505, as best seen on FIG. 6.

Figure 7:
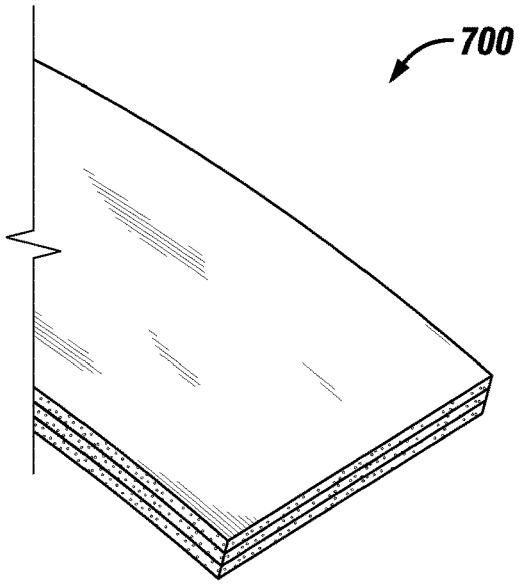
FIG. 7 illustrates an example of a bias fabric.

While woven mesh 400 may be used to reinforce annular seal 220 (e.g., referring to FIG. 2), there may be other examples of reinforcement. FIG. 7 illustrates an example of a bias fabric 700. Similarly to woven mesh 400 (e.g., referring to FIG. 4) bias fabric 700 may provide reinforcement for annular seal 220. As illustrated, bias fabric may include multiple layers of a fabric-reinforced composite. Annular seal 220 may be coupled to bias fabric 700. Bias fabric 700 may limit deformation of annular seal 220 while being disposed downhole, protect annular seal 220 from minor mechanical loading, constrain annular seal 220 during the setting process so as to prevent a partial loss of annular seal 220, reduce the fluctuation of annular seal 220 performance as temperature increases, and/or combinations thereof. Bias fabric 700 may be any suitable size, height, and/or shape. Without limitation, a suitable shape may include, but is not limited to, cross-sectional shapes that are circular, elliptical, triangular, rectangular, square, hexagonal, and/or combinations thereof. Without limitation, bias fabric 700 may include any suitable material such as metals, nonmetals, polymers, ceramics, and/or any combination thereof. In examples, bias fabric 700 may include synthetic materials, such as poly-paraphenylene terephthalamide, polyamides, aliphatic or semi-aromatic polyamides (generically referred to as nylon), polyesters, polyolefins, cellulose (e.g. manufactured cellulose fibers referred to as rayon), or natural materials, such as cotton, wool, silk, linen, or hemp.

Bias fabric 700 may be disposed around expansion element 230 (e.g., referring to FIG. 2) of expandable liner hanger 105 (e.g., referring to FIG. 1) prior to disposing annular seal 220 around expansion element 230 between first spike 300A (i.e., referring to FIG. 3) and second spike 300B (e.g., referring to FIG. 3). The components of annular seal 220 may be disposed about bias fabric 700 prior to vulcanization of annular seal 220. During vulcanization, annular seal 220 may bond with bias fabric 700. Bias fabric 700 may retain structural integrity and provide added strength to annular seal 220.

During operations, once wellbore 160 (e.g., referring to FIG. 1) is drilled in a subterranean operation, it may be cased using methods and systems known to those of ordinary skill in the art. For instance, tubular string 175 (e.g., referring to FIG. 1) may be lowered into wellbore 160 and cemented in place. Liner 215 (e.g., referring to FIG. 2) coupled to expandable liner hanger 105 (e.g., referring to FIG. 1) in accordance with an implementation of the present disclosure may then be lowered downhole through tubular string 175. Once liner 215 reaches a desired position downhole, the expansion element 230 of expandable liner hanger 105 may expand. Once expandable liner hanger 105 expands, annular seals 220 (e.g., referring to FIG. 2) may form a seal with the inner surface of tubular string 175. This seal may couple liner 215 to tubular string 175. Concerning the present disclosure, the implementation of woven mesh 400 (e.g., referring to FIG. 4) and/or bias fabric 700 may increase the structural integrity, axial load resistance and/or extrusion resistance of expandable liner hanger 105.

Accordingly, this disclosure describes systems and methods that may relate to improved liner hanger systems. The systems and methods may further be characterized by one or more of the following statements:

Statement 1. A downhole expandable liner hanger positioned in a subterranean wellbore may be provided. The downhole expandable liner hanger may include a liner. The downhole expandable liner hanger may further include an expansion element. The expansion element may include one or more annular seals bonded to the expansion element, a first spike; and a second spike. The downhole expandable liner hanger may further include a woven mesh, wherein the woven mesh is disposed around the expansion element between the first spike and the second spike, wherein the woven mesh includes a first material layer and a second material layer.

Statement 2. The downhole expandable liner hanger of statement 1, wherein the woven mesh is disposed within the one or more annular seals.

Statement 3. The downhole expandable liner hanger of statement 2, wherein the one or more annular seals are bonded to the woven mesh through vulcanization.

Statement 4. The downhole expandable liner hanger of any preceding statement, wherein the first material layer and the second material layer include a metal.

Statement 5. The downhole expandable liner hanger of statement 4, wherein the metal is selected from a group consisting of a stainless steel, a carbon steel, a carbon alloy, a nickel alloy, and combinations thereof.

Statement 6. The downhole expandable liner hanger of any preceding statement, wherein the first material layer and the second material layer are woven together into a pattern, wherein the pattern is one selected from a group consisting of plain weave, oxford, twill, herringbone, dobby, satin, velvet, basket weave, jacquard, leno, or combinations.

Statement 7. The downhole expandable liner hanger of any preceding statement, further including a third material layer, wherein the third material layer is disposed between the first material layer and the second material layer.

Statement 8. The downhole expandable liner hanger of statement 7, wherein the third material layer is a solid sheet of material.

Statement 9. The downhole expandable liner hanger of statement 7 or 8, wherein the first material layer and the second material layer are pre-woven, wherein the first material layer and the second material layer include holes.

Statement 10. The downhole expandable liner hanger of statement 9, wherein the third material layer includes strands of material disposed parallel to each other, wherein the third material layer is interwoven between the first material layer and the second material layer through the holes.

Statement 11. A downhole expandable liner hanger positioned in a subterranean wellbore may be provided. The downhole liner hanger may include a liner. The downhole liner hanger may further include an expansion element. The expansion element may include one or more annular seals disposed around the expansion element, a first spike, and a second spike. The downhole liner hanger may further include a bias fabric that include multiple sheets of a fiber-reinforced fabric, wherein the bias fabric is disposed around the expansion element between the first spike and the second spike.

Statement 12. The downhole expandable liner hanger of statement 11, wherein the bias fabric is disposed between the expansion element and the one or more annular seals.

Statement 13. The downhole expandable liner hanger of statement 12, wherein the one or more annular seals are bonded to the bias fabric through vulcanization.

Statement 14. The downhole expandable liner hanger of any one of statements 11 to 13, wherein the bias fabric includes a material selected from a group consisting of a poly-paraphenylene terephthalamide, a polyamide, an aliphatic polyamide, a semi-aromatic polyamide, a polyester, a polyolefin, a cellulose, a cotton, a wool, a silk, a linen, a hemp, and combinations thereof.

Statement 15. A downhole expandable liner hanger positioned in a subterranean wellbore may be provided. The downhole expandable liner hanger may include a liner. The downhole expandable liner hanger may further include an expansion element, wherein the expansion element includes one or more annular seals bonded to the expansion element. The downhole expandable liner hanger may further include a woven mesh, wherein the woven mesh is disposed around the expansion element, wherein the woven mesh includes a first material layer and a second material layer.

Statement 16. The downhole expandable liner hanger of statement 15, wherein the woven mesh is disposed within the one or more annular seals, wherein the one or more annular seals are bonded to the woven mesh through vulcanization.

Statement 17. The downhole expandable liner hanger of statement 15 or 16, wherein the first material layer and the second material layer include a metal, wherein the metal is selected from a group consisting of wherein the metal is selected from a group consisting of a stainless steel, a carbon steel, a carbon alloy, a nickel alloy, and combinations thereof.

Statement 18. The downhole expandable liner hanger of any one of statements 15 to 17, further including a third material layer, wherein the third material layer is disposed between the first material layer and the second material layer.

Statement 19. The downhole expandable liner hanger of statement 18, wherein the third material layer is a solid sheet of material.

Statement 20. The downhole expandable liner hanger of statement 18 or 19, wherein the first material layer and the second material layer are pre-woven, wherein the first material layer and the second material layer include holes, wherein the third material layer includes strands of material disposed parallel to each other, wherein the third material layer is interwoven between the first material layer and the second material layer through the holes.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole expandable liner hanger comprising:
an expansion element; and
one or more annular seals disposed on the expansion element, the one or more annular seals comprising:
a first mesh comprising individual strands;
a solid sheet;
a second mesh comprising individual strands, the solid sheet disposed between the first mesh and the second mesh; and
wherein holes between the individual strands of the first mesh are larger than holes between the individual strands of the second mesh.

2. The downhole expandable liner hanger of claim 1, wherein the individual strands of the first mesh are different than the individual strands of the second mesh.

3. The downhole expandable liner hanger of claim 2, wherein the one or more annular seals are bonded to the individual strands of the first mesh and the second mesh through vulcanization.

4. The downhole expandable liner hanger of claim 1, wherein the individual strands of the first mesh are thicker than the individual strands of the second mesh.

5. The downhole expandable liner hanger of claim 1, wherein the solid sheet is adjacent to the second mesh.

6. The downhole expandable liner hanger of claim 1, wherein the solid sheet is adjacent to the first mesh.

7. The downhole expandable liner hanger of claim 1, wherein the solid sheet is adjacent to the second mesh and the first mesh.

8. The downhole expandable liner hanger of claim 1, wherein the solid sheet is disposed between the holes of the first mesh and the holes of the second mesh.

9. The downhole expandable liner hanger of claim 1, wherein the individual strands of the first mesh are different than the individual strands of the second mesh.

10. A downhole expandable liner hanger comprising:
an expansion element, one or more annular seals extending between a first spike and a second spike,
the one or more annular seals disposed on the expansion element, the one or more annular seals comprising:
a first mesh comprising individual strands;
a second mesh comprising individual strands; and
a solid sheet disposed between the first mesh and the second mesh, wherein holes between the individual strands of the first mesh are larger than holes between the individual strands of the second mesh.

11. The downhole expandable liner hanger of claim 10, wherein the individual strands of the first mesh are thicker than the individual strands of the second mesh.

12. The downhole expandable liner hanger of claim 10, wherein the solid sheet is adjacent to the second mesh.

13. The downhole expandable liner hanger of claim 10, wherein the solid sheet is adjacent to the first mesh.

14. The downhole expandable liner hanger of claim 10, wherein the solid sheet is adjacent to the first mesh and the second mesh.

15. A liner hanger comprising:
an expansion element; and
one or more annular seals disposed on the expansion element, the one or more annular seals comprising:
a first mesh comprising individual strands;
a second mesh comprising individual strands; and
a solid sheet disposed between the first mesh and the second mesh; and
wherein holes between the individual strands of the first mesh are larger than holes between the individual strands of the second mesh, wherein the solid sheet is disposed between the holes of the first mesh and the holes of the second mesh.

16. The liner hanger of claim 15, wherein the individual strands of the first mesh are different than the individual strands of the second mesh.

17. The liner hanger of claim 15, wherein the individual strands of the first mesh are thicker than the individual strands of the second mesh.

18. The liner hanger of claim 15, wherein the solid sheet is adjacent to the first mesh and the second mesh.

19. The liner hanger of claim 15, wherein the solid sheet is adjacent to the first mesh.

20. The liner hanger of claim 15, wherein the individual strands of the first mesh are thicker than the individual strands of the second mesh.

* * * * *